US008939083B1

(12) United States Patent
Desch et al.

(10) Patent No.: US 8,939,083 B1
(45) Date of Patent: Jan. 27, 2015

(54) FUZE SAFING SYSTEM

(75) Inventors: Noah Desch, Cincinnati, OH (US); Tim B. Bonbrake, Tucson, AZ (US)

(73) Assignee: L3 Fuzing and Ordnance Systems, Cincinnati, OH (US)

( * ) Notice: Subject to any disclaimer, the term of this patent is extended or adjusted under 35 U.S.C. 154(b) by 197 days.

(21) Appl. No.: 13/507,553

(22) Filed: Jul. 3, 2012

(51) Int. Cl.
*F42C 15/24* (2006.01)

(52) U.S. Cl.
CPC ..... *F42C 15/24* (2013.01)
USPC ..... 102/247; 102/222; 102/206; 102/215; 102/262

(58) Field of Classification Search
USPC ..... 102/200, 206, 215, 216, 221, 222, 247, 102/262; 244/3.1, 3.15, 3.23
See application file for complete search history.

(56) References Cited

U.S. PATENT DOCUMENTS

| | | | | |
|---|---|---|---|---|
| 4,632,012 | A * | 12/1986 | Feige et al. | 89/41.09 |
| 8,124,921 | B2 | 2/2012 | Geswender et al. | |
| 8,338,768 | B2 * | 12/2012 | Hanlon et al. | 244/3.22 |
| 8,519,313 | B2 * | 8/2013 | Geswender et al. | 244/3.2 |
| 8,558,153 | B2 * | 10/2013 | Geswender | 244/3.24 |
| 8,820,241 | B2 * | 9/2014 | Kautzsch et al. | 102/247 |

OTHER PUBLICATIONS

Edward S. Getson, Air Vehicle / Store Compatibility Flight Test Engineer NAVAIR 4.11.2.4, Telemetry Solutions for Weapon Separation Testing,12 pgs.

Daniel Roetenberg, per J. Slycke and Peter H. Veltink, Ambulatory Position and Orientation Tracking Fusing Magnetic and Inertial Sensing, IEEE Transactions on Biomedical Engineering, vol. 54, No. 5, May 2007, 8 pgs.

Using Quaternion to Perform 3D Rotations, 5 pgs, http:/www.cprogramming.com/tutorial/3d/quaternions.html.

Conversion between quaternions and Euler angles, 2012, 4 pgs, http://en/wikipedia.org/wiki/Conversion_between_quaternions_and_Euler_angles.

Jan Vrbik, Motion of a Spinning Top, The Mathematics Journal 14, copyright 2012, Wolfram Media, Inc., 11 pgs.

* cited by examiner

*Primary Examiner* — James S Bergin
(74) *Attorney, Agent, or Firm* — Harness, Dickey & Pierce, P.L.C.

(57) ABSTRACT

The safing system employs a multi-axis accelerometer system and multi-axis gyroscope system and a processor that is programmed to iteratively read acceleration data from the accelerometer system and apply a multi-axis rotation on the acceleration data using gyroscope data iteratively read from the gyroscope system to generate rotationally corrected acceleration data and further programmed to calculate a cumulative distance measure using the rotationally corrected acceleration data. The processor then compares the cumulative distance measure with a predetermined reference measure and to issue a control signal to enable arming of the device when the cumulative distance measure exceeds the reference measure.

36 Claims, 8 Drawing Sheets

FUZE SAFING SYSTEM

FIELD

The present disclosure relates generally to safing (safety) systems for arming explosive devices and more particularly to a safing system that uses three-axis motion sensing to assess whether the device has traversed its trajectory to a safe distance from the launch point.

BACKGROUND

This section provides background information related to the present disclosure which is not necessarily prior art.

When launching an explosive device on a trajectory towards a given target, the device can be made safer by equipping it with a safing system. The safing system prevents the device from being armed until after it has traveled a safe distance from the launch site. The safing technique has been traditionally employed in artillery shells, for example, by utilizing a mechanical system that counts the number of spiral rotations the shell makes in flight. In this regard, the spiral rifling pattern within the bore of the cannon imparts the spiral rotation to the shell. Thus, knowing the muzzle velocity of the shell and the geometry of the rifling pattern, one can calculate how many shell rotations will take place by the time the shell reaches a safe distance from the launch site. The mechanical system simply counts those rotations and arms the device after the safe number of rotations has occurred. Torpedoes launched from submarines work in a similar fashion, by counting the number of rotations of the torpedo's propeller after launch.

This counting-rotations technique is not applicable to all types of devices, however. For example, self-guided missiles, dropped bombshells and other projectiles may be launched or deployed without a spiral rotation imparted. In such devices there is no reliable spiral rotation to count; thus conventional rotation counting safing systems do not work. One traditional solution in such cases has been to use a single-axis accelerometer located on the device, which by sensing motion in the launch direction can provide a signal indicative of distance from the launch site. If the trajectory of the device follows a predictable, known path, such as a parabolic arc induced by forces of gravity, a single-axis accelerometer can provide a useful distance measure. However, if the device deviates from the predictable known path for some reason, the single-axis accelerometer may be of limited value and a safing system based on a single-axis solution cannot be relied upon in all cases. A single-axis solution would not be able to accurately assess the safe distance if the device is a self-guided missile that has made a U-turn and has doubled back on its trajectory, for example.

SUMMARY

This section provides a general summary of the disclosure, and is not a comprehensive disclosure of its full scope or all of its features.

The safing system disclosed here addresses the shortcomings of conventional safing technology by employing a three-axis accelerometer system with an associated three-axis gyroscope system that can calculate when a safe distance has been attained, even though the device cannot be assured to follow a predictable known trajectory.

In accordance with the present disclosure, the safing system controls arming of a device by employing a multi-axis accelerometer system and a multi-axis gyroscope system. A processor is programmed to iteratively read acceleration data from the accelerometer system and apply a multi-axis rotation on the acceleration data using gyroscope data iteratively read from the gyroscope system to generate rotationally corrected acceleration data and further programmed to calculate a cumulative distance measure using the rotationally corrected acceleration data. The processor is further programmed to compare the cumulative distance measure with a predetermined reference measure and to issue a control signal to enable arming of the device when the cumulative distance measure exceeds the reference measure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6A:
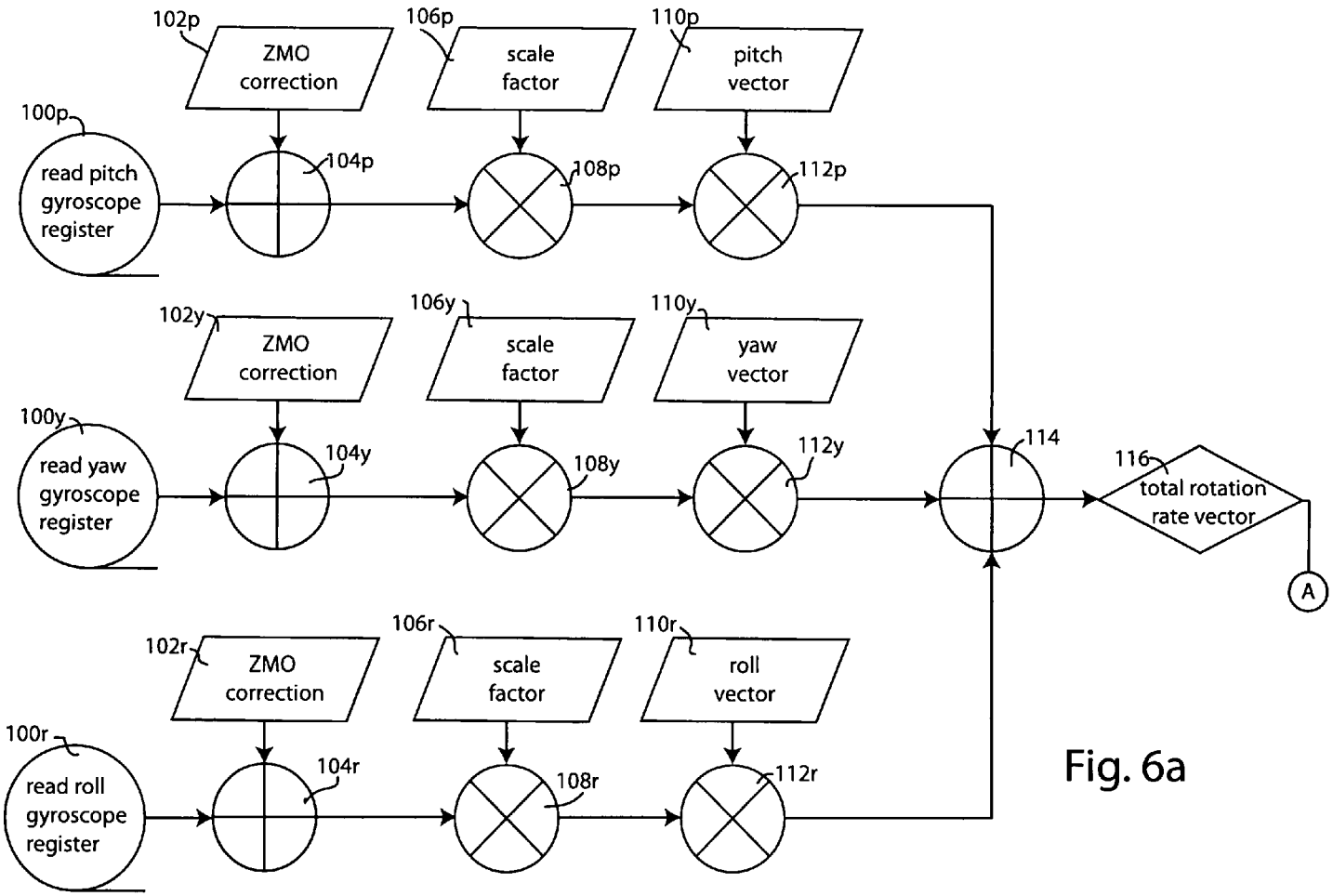
Figure 6B:
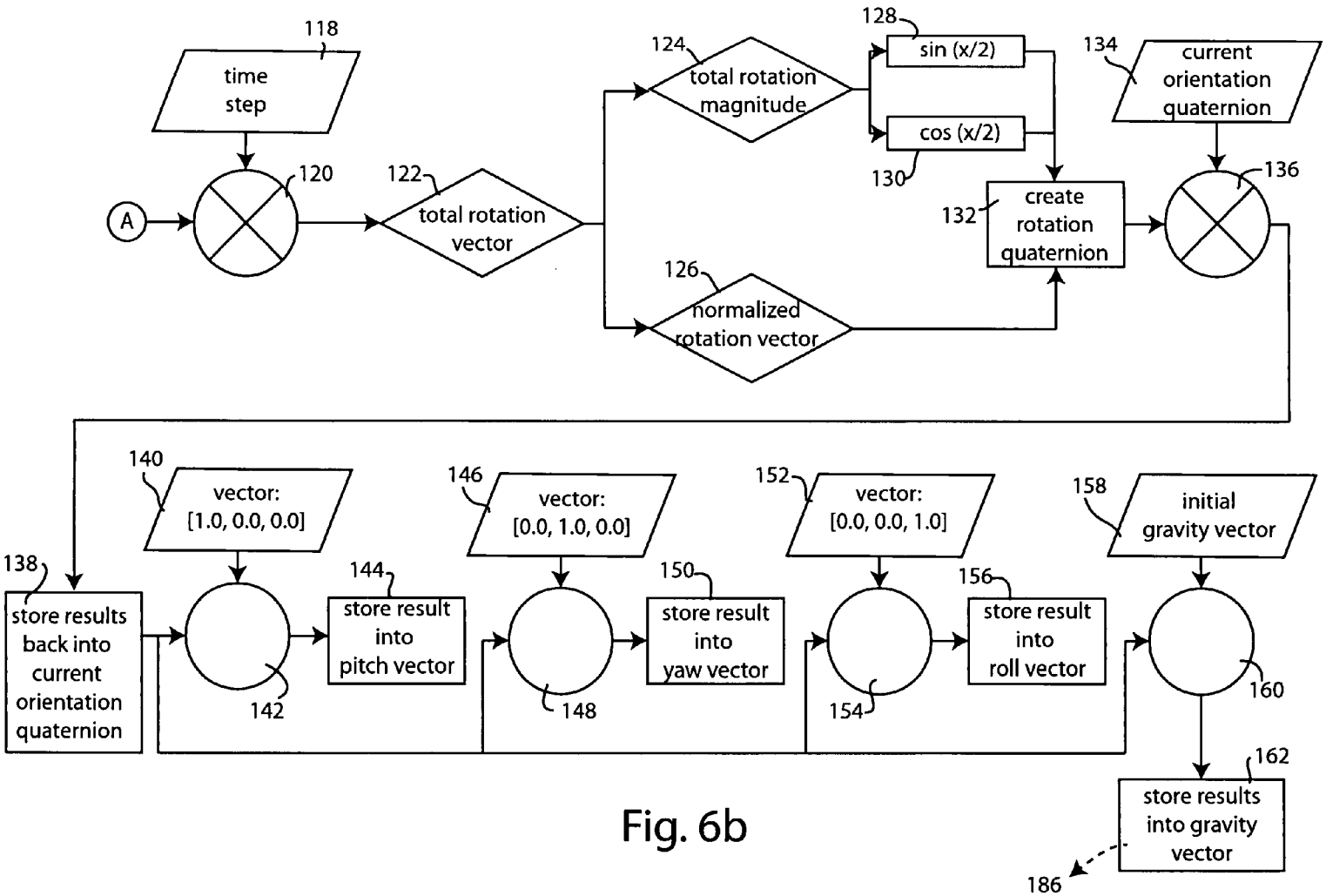
Figure 7A:
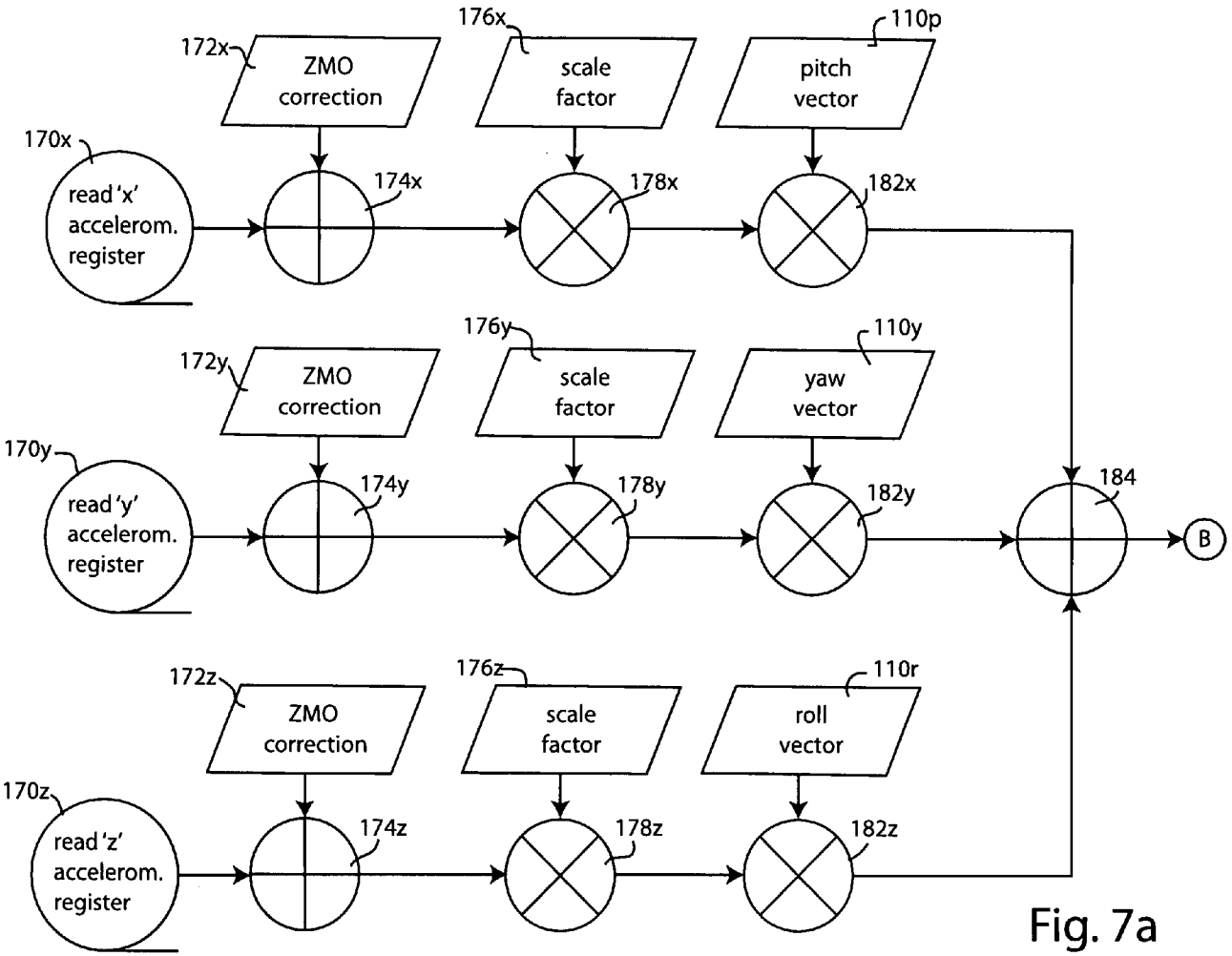
Figure 7B:
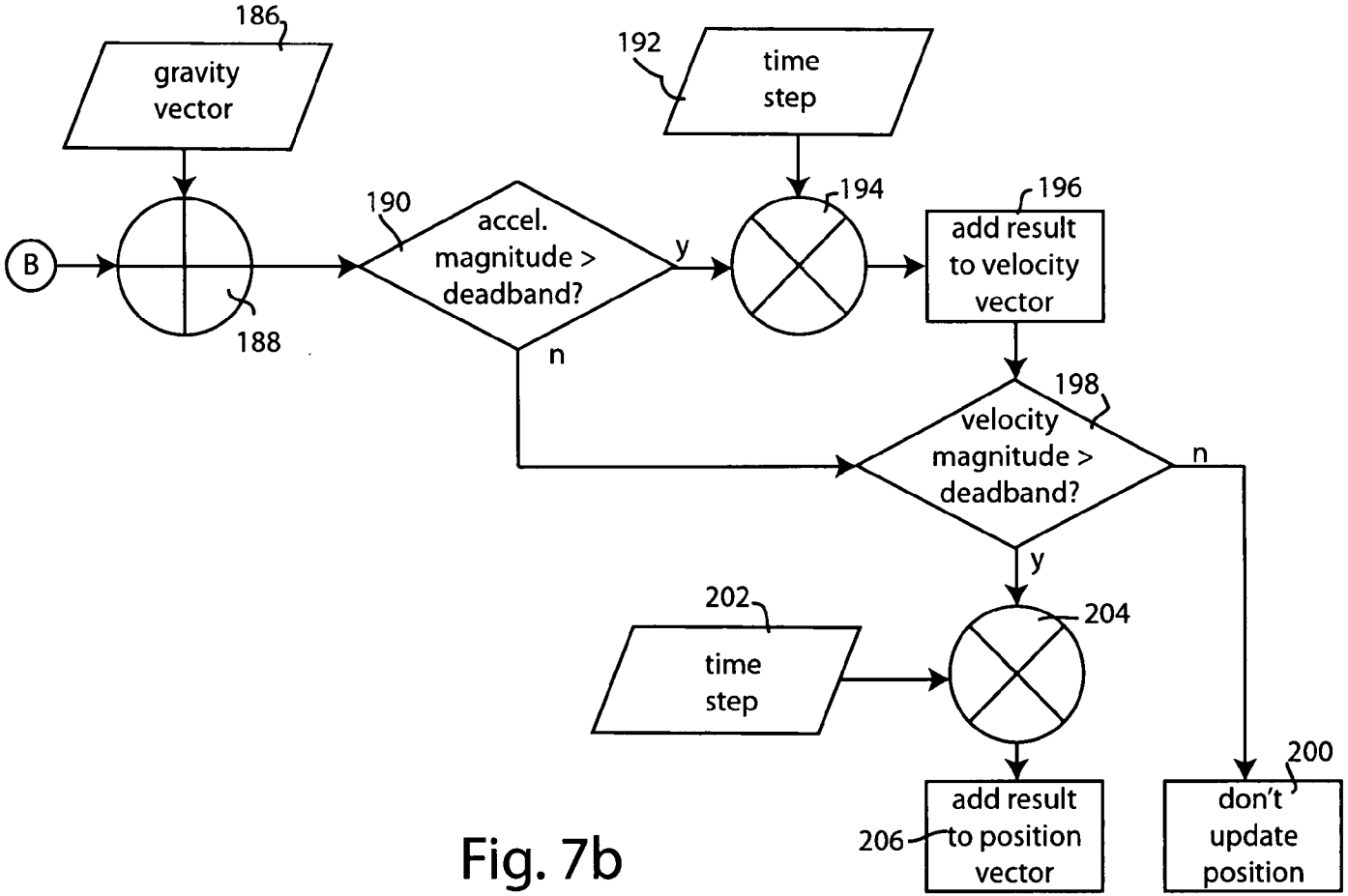
Figure 8:
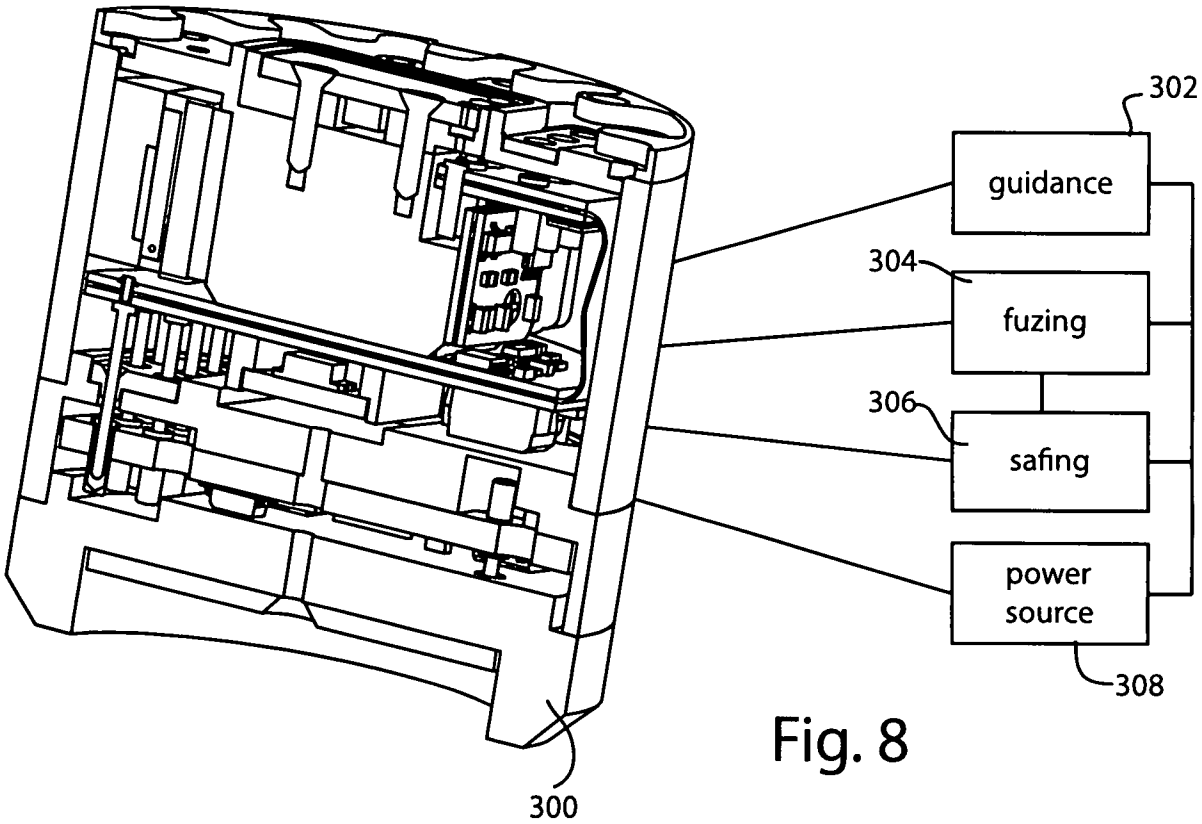

FIGS. 6*a* and 6*b* comprise a flow diagram illustrating the manner in which the microprocessor is programmed to process and use data from the three-axis gyroscope system;

FIGS. 7*a* and 7*b* comprise a flow diagram illustrating the manner in which the microprocessor is programmed to process and use data from the three-axis accelerometer system;

FIG. 8 is a cross-sectional view of an exemplary electronics package for providing the guidance, fuzing, and safing functions, with associated power source within a fuzed device.

Corresponding reference numerals indicate corresponding parts throughout the several views of the drawings.

DETAILED DESCRIPTION

Example embodiments will now be described more fully with reference to the accompanying drawings.

The safing system may be deployed on a variety of different devices. For illustration purposes, an air-to-air missile 10 will be featured in this example. The air-to-air missile 10 is launched from an aircraft 12. Once launched, the missile travels under its own propulsion on a trajectory dictated by the missile's internal guidance system. The safing system is deployed on the missile and operates to activate the device (e.g., activate the fuze) or to send a signal to an arming system to allow the arming system to activate the device or fuze, thereby arming the missile after the missile is a safe distance from the aircraft 12. With a conventional unguided bomb, the trajectory can be assumed to follow a path dictated by the forces of gravity and thus a simple, single axis fuze safing mechanism would be adequate. However, in the case of the air-to-air missile 10, the missile follows its own guidance system and operates under its own jet propulsion, thus it is possible that the missile could loop back on its course and thus find itself in unsafe proximity to the aircraft when an arming decision must be made. The three axis safing system disclosed here addresses this problem.

FIG. 8 shows an exemplary electronics package at 300, which comprises a set of axially aligned, interconnected circuit boards which comprise the respective guidance 302, fuzing 304, safing 306 systems. These systems are preferably performed using their own dedicated subsystems, with power supplied to all subsystems from a common power source 308. Note that the fuzing system 304 is coupled to the safing system 306, to allow the safing system to control whether the fuze may be safely armed. The guidance system 302 which is responsible for guiding the device after deployment or launch is preferably separate from the fuzing and safing systems. In other words, the guidance system uses its own accelerometers, gyroscopes, radio receivers, GPS receivers and the like; for reliability and fail-safe reasons these guidance system components are preferably not shared with the safing system 306.

Figure 2:
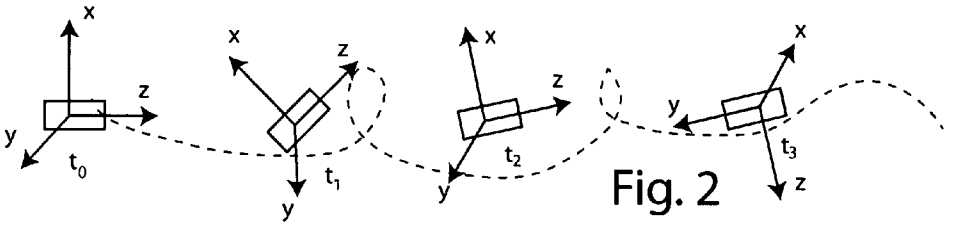
FIG. 2 is a free body diagram illustrating how the reference frame of the safing system is subject to rotation about the pitch, yaw and roll axes.

The fuze safing operation of the safing system 306, which operates upon data in three dimensions and three axes of rotation, is considerably more difficult than might appear at first blush. This is because the reference frame of the projectile may potentially undergo not only translations in three dimensional space but also rotations about each of the pitch, roll and yaw axes. This is illustrated in FIG. 2, where the projectile reference frame 14 is established with respect to the body 16 of the fuze safing system. As illustrated in FIG. 2, the reference frame 14 can theoretically change with respect to all six degrees of freedom (x, y, z, yaw, pitch, roll) from instant to instant ($t_0$, $t_1$, $t_2$, $t_3$). While the projectile would not necessarily be designed to tumble in space as illustrated in FIG. 2, the fuze safing system needs to take this possibility into account. For example, if the guidance system of missile 10 were to malfunction, or if its control surfaces were to become damaged, it is entirely possible that the missile 10 could tumble in space in a largely unpredictable fashion. The fuze safing system of the disclosure is designed to track such behavior and control the arming of the fuze so that a safe arming distance can be ensured.

Figure 1:
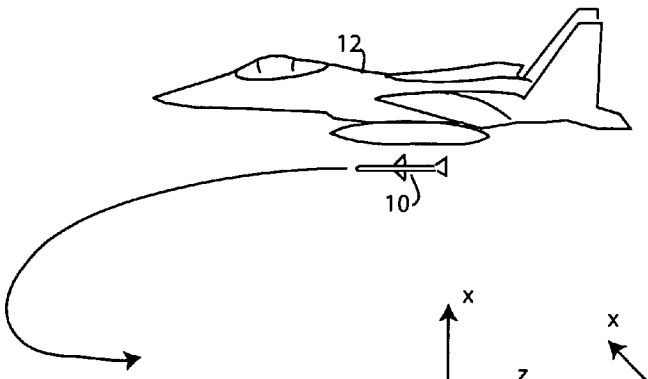
FIG. 1 illustrates an exemplary air-to-air missile launched from an aircraft, useful in understanding the safing system of the present disclosure.

It bears repeating that the surface-to-air missile example shown in FIG. 1 is not intended as a limitation of the present fuze safing system. Indeed, the fuze safing system disclosed here can be used with both self-guided and unguided projectiles, including projectiles launched or dropped from aircraft, projectiles shot from ground-based launchers and cannons, and also launched from marine and submarine vessels. Moreover, while the example featured here is an explosive device, the disclosed safing system may also be used where the payload is not explosive. Thus, for example, the safing system could be utilized in a multi-stage rocket, where separation of a first stage from a second stage would not be permitted until a proper distance has been traversed.

Figure 3:
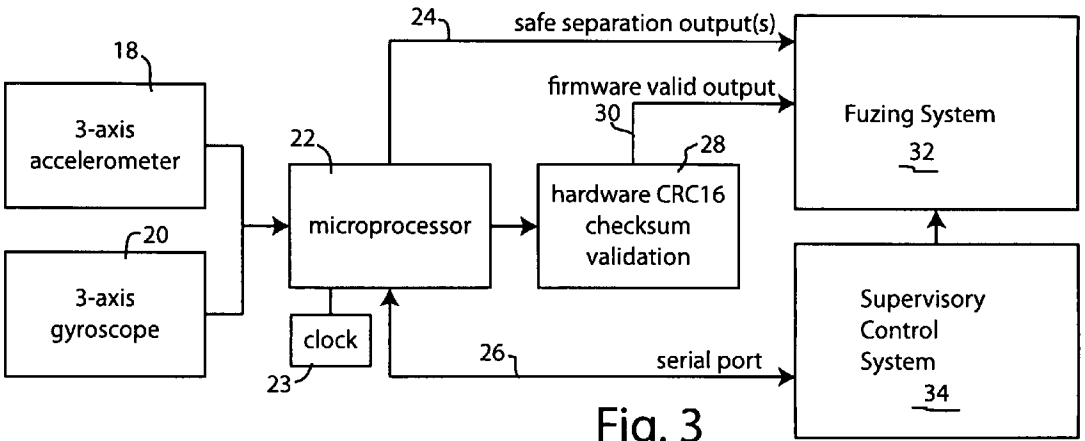
FIG. 3 is a block diagram depicting an embodiment of the fuze safing system.

One embodiment of the fuze safing system in accordance with the present disclosure is shown in FIG. 3. The fuze safing system includes a multi-axis accelerometer system, such as three axis accelerometer system 18 and a multi-axis gyroscope system, such as a three axis gyroscope system 20. The outputs of these respective systems are fed to microprocessor or microcontroller 22 that has been programmed as described more fully herein to perform the fuze safing function. Microprocessor 22 may be implemented, for example, using a digital signal processor (DSP) device, such as a DSPIC33FJ16GS502. The microprocessor 22 supplies on its "safe separation" output port 24, a logical value used by the fuzing system to determine if the calculated slant distance is great enough to provide a margin of safety. The microprocessor 22 may be controlled and communicated with by serial port 26 as will be discussed.

The fuze safing system also includes a failsafe mechanism 28 that ensures not only that microprocessor 22 is operating but also that the executable code running on microprocessor 22 has not been altered or tampered with. This is done by calculating a CRC 16 checksum that corresponds to the set of instructions operating microprocessor 22. This CRC 16 checksum is stored in a non-volatile computer-readable storage location. When microprocessor 22 first boots up, it calculates a checksum of its own operating instructions and compares that checksum with the stored checksum in the failsafe system 28. If these two checksums do not match, then it is assumed that the microprocessor is inoperative or that the executable program code has been damaged or tampered with. In such instance, the failsafe system provides on its "firmware valid" output port 30 an indication that the fuze safing system is not operative. Under such circumstances, the fuzing system would abort the fuzing operation.

One of the challenges of constructing a fuze safing system is that the arming decision must typically be made fairly quickly after deploying the device. By way of example, a typical arming sequence might be effected five seconds after the device is launched or deployed. This means that the fuze safing system has only five seconds to arrive at a solution. Given the high speeds with which many modern-day projected devices travel, a significant distance can be traversed in five seconds. Thus, a fuze safing system may need to make many hundreds of calculations per second in order to accurately determine whether a safe distance has been achieved.

Figure 4:
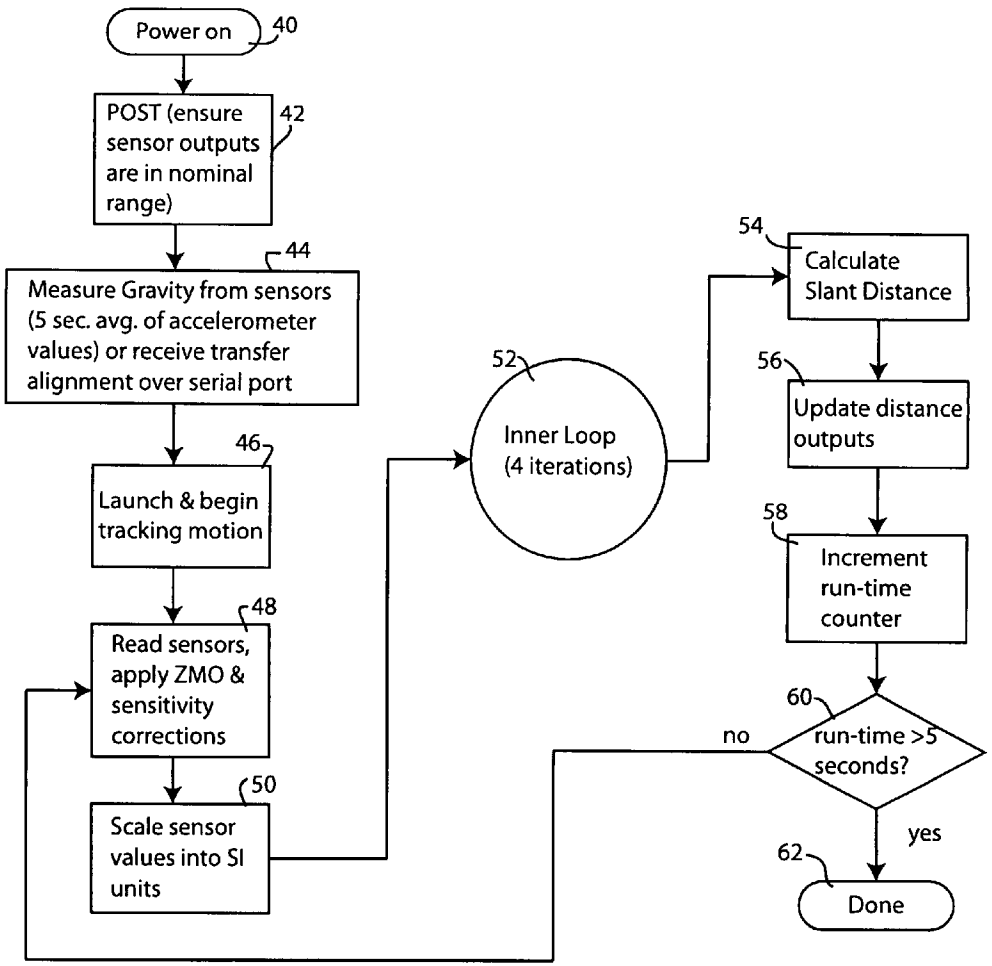
FIG. 4 is a flowchart diagram depicting how the microprocessor is programmed to effect an outer loop used in controlling the safe arming of a fuzed device.
Figure 5:
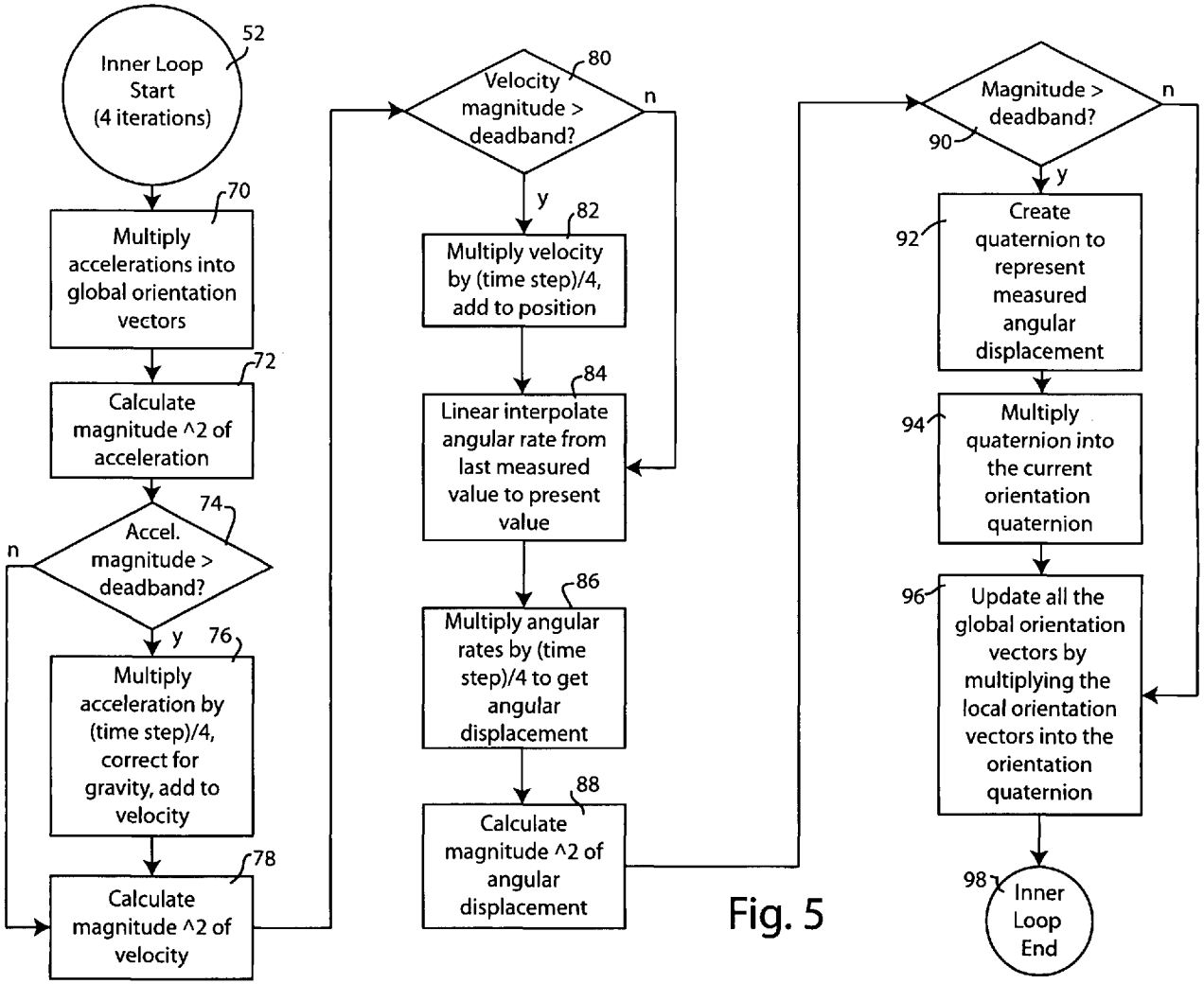
FIG. 5 is a flowchart diagram depicting how the microprocessor is programmed to effect an inner loop used in measuring displacement in view of changes in orientation of the three-axis accelerometer measurement system.

To achieve this responsiveness, the disclosed fuze safing system employs a nested loop iterative algorithm depicted in FIGS. 4 and 5. Referring first to FIG. 4, the microprocessor-implemented algorithm begins at power-on step 40. Power-on occurs as part of the deployment or launch sequence and is triggered by a signal communicated to the microprocessor 22 (FIG. 3) via its serial port 26.

Next, at step 42 a power-on self-test (POST) is performed to ensure that the three axis accelerometer 18 and three axis gyroscope 20 sensor outputs are in nominal range. As part of the power-on self-test routine, the microprocessor reads the hardware CRC 16 checksum from the fail safe system 28 (FIG. 3), as discussed above, to ensure that its program code has not been tampered with. As a result of performing this test, the power-on self-test also ensures that the microprocessor is, itself, operating. In this regard, if the processor is not able to perform the CRC 16 checksum validation, then a microprocessor is assumed to be inoperative.

Once the power-on self-tests have been performed, the microprocessor, at step 44, obtains an initial gravity measurement. In most applications where the device is deployed within the gravitational field of a large mass, such as the Earth, forces of gravity do affect the readings obtained by the three axis accelerometer 18 and thus the microprocessor is programmed to compensate for this. There are several ways that the initial gravity measurement can be achieved. In one embodiment, data from the three axis accelerometer system 18 are averaged over a predetermined time interval, such as five second, to arrive at an indication of gravity prior to device deployment or launch. In an alternate embodiment, an external system can obtain a gravity measurement and supply it to the microprocessor via its serial port 26. As will be discussed below, the gravity measurement is updated as the safe arming calculations are being performed. Thus at each incremental step in the calculations, the effects of gravity are accounted for.

Step 46 represents the point at which the device is launched or deployed. Microprocessor 22 is supplied a launch signal via the serial port, whereupon it begins tracking motion using data from the three axis accelerometer 18 and from the three axis gyroscope 20. In essence, step 46 represents time zero, position zero and reference frame establishment. Subsequent movements are assessed with respect to these initial starting time, position and reference frame, to determine if and/or when the device has achieved a safe distance for arming. The microprocessor 22 has an onboard clock 23 to measure local time intervals. Traversed distances in each of the three axes are incrementally measured starting from the (0,0,0) position where the three axis accelerometer was located at the instant of launch. The three axis gyroscope orientation at the moment of launch defines the axes of the local reference frame onboard the device at the time of launch.

Next, data are read or sampled from the three axis accelerometer and three axis gyroscope sensors at step 48 and certain corrections are applied to the raw data values. For example, in many instances the sensor technology used in the three axis accelerometer and three axis gyroscope can sometimes produce non-zero outputs even when they are not undergoing acceleration or rotation. These non-zero outputs are merely an undesired offsets attributable to the internal electronic circuitry. To compensate for this, a zero measurand output (ZMO) correction factor is applied to cancel out the undesired offset. After making this correction, additional sensitivity corrections may be applied to the data to bring the measured values within predefined nominal ranges. Thereafter, at step 50, the corrected sensor values are further scaled into single integer units. In this regard, the values are expressed as single integer operands because these can be manipulated by the microprocessor at high speed. Thus, at step 50 the microprocessor has available to it current instantaneous readings, expressed as single integers, of each of the three accelerometer axes and each of the three gyroscope axes.

In order to represent both whole number and fractional components, the signal integer unit representation can be subdivided into whole integer and fractional portions. For example, an embodiment may represent physical values (acceleration, velocity, position, etc.) as 32-bit fixed point numbers, with 16 bits representing the whole number integer portion and 16 bits representing the fraction portion. As will be discussed, different bit allocations may be used where more resolution is required in one component versus the other.

Next, the microprocessor enters a nested iterative loop 52. The details of the inner loop 52 are shown in FIG. 5 and will be discussed momentarily. Essentially, the inner loop computes the incremental distance traveled between the current entry into loop 52 and the previous entry. If this is the first entry into loop 52, the inner loop computes the distance traversed since the launch began at step 46, that is, as measured from the original (0,0,0). In the illustrated embodiment, the inner loop performs four iterations before exiting to step 54. While the clock speeds can vary depending on the capabilities of the sensors and microprocessor, an exemplary embodiment executes the outer loop of FIG. 4 at 400 times per second (400 Hz.), and executes the inner loop at 1600 times per second (1600 Hz.).

As a result of the inner loop calculations, the microprocessor has values stored within its memory that correspond to the incremental distances traversed, taking into account any rotations that may have occurred in any of the three gyroscope axes during that increment. Taking rotation into account is very important as was illustrated in FIG. 2. To review this point, an accelerometer oriented at launch to measure acceleration along the x axis would give an entirely wrong impression of distance traveled were the body on which the sensor is mounted to rotate 90 degrees during the measurement cycle, so that the x-axis accelerometer ends up pointing in a y-axis direction. The inner loop 52 compensates for all of this by utilizing data from the three axis gyroscope as will be discussed in connection with FIG. 5.

Thus, at step 54 the microprocessor uses the incremental distance traveled, taking all three position dimensions and all three rotation orientations into account, to compute a Slant Distance. The Slant Distance is generally defined as the distance from the origin (at launch) to the current position of the device. Because the outer loop shown in FIG. 4 obtains displacement values in periodic increments (e.g., 400 Hz increments), the Slant Distance is calculated by summing the squares of the individual x, y and z components of these incremental displacements. In this regard, the true incremental distance would be calculated by taking the square root of the sum of the squares. However, to reduce the computational burden on the microprocessor, the square root step is dispensed with. It is possible to do so because the Slant Distance squared can be readily compared with the safe distance squared to arrive at a safe arming decision.

Having calculated the current Slant Distance, the microprocessor then updates distance output values at step 56 to make these values available to the arming algorithm. These safe separation outputs were shown at 25 in FIG. 3 and are used by the fuzing system to make a decision whether the device is far enough distant from the origin to allow the device to be armed.

In the illustrated embodiment, the outer loop is configured to run for a predetermined length of time, a time that is tested for at step 60. For example, the outer loop may be configured to run for five seconds. The time interval used at step 60 is dependent upon the requirements of the application, with five seconds being a typical value for many munitions applications. If the time interval has not elapsed, the microprocessor branches back to step 48 where the sensors are again read and the outer loop is repeated. Once the time interval (e.g., 5 sec.) has lapsed, the outer loop ends at step 62.

Refer now to FIG. 5 which shows the manner in which the microprocessor is programmed to perform the inner loop 52. As previously discussed, the inner loop 52 is configured to execute a multiple of times before exiting. In the illustrated embodiment, the inner loop performs four iterations before exiting. Thus, the calculations performed in the inner loop occur four times as frequently as the calculations performed in the outer loop of FIG. 4.

The process begins at step 70 where the acceleration data from the three axis accelerometer (after having been corrected by the outer loop) are used to define global orientation vectors corresponding to each of the pitch, yaw and roll orientations. This step will be discussed more fully in connection with FIGS. 6*a*-6*b* and 7*a*-7*b*. Essentially, at step 70 the current orientation for each of the accelerometer sensors within the three axis accelerometer system is accounted for by using data from the three axis gyroscope 20. Thus, step 70 compensates for the problem illustrated in FIG. 2 whereby the accelerometer axes rotate as displacement occurs.

Because the measurement system for computing Slant Angle operates on incremental angles, there is a possibility for unwanted cumulative error to creep into the solution. Small incremental changes in position can add up over time to give the impression that a large distance has been traversed when, in fact, the distance perceived is merely an artifact of adding up a large number of infinitesimal values that should have been disregarded.

To compensate for this effect, the inner loop uses a series of dead bands that function to disregard small positional and rotational changes so they will not accumulate in the end solution. Thus, at step 72 the magnitude of the acceleration values for each of the three axes are obtained and squared. These magnitude squared values are then compared at step 74 to determine if they exceed a predefined dead band value. If so, the newly acquired acceleration values are added to the solution at step 76, otherwise they are not and the program merely branches to step 78, bypassing step 76. As previously noted, the illustrated implementation works with magnitude squared values and foregoes the square root step to reduce computational burden on the microprocessor and thus allowing the algorithm to operated more quickly.

If step 76 is performed, the acceleration values obtained from the outer loop are time integrated by multiplying by a time step interval to arrive at a velocity value. To explain this in simple terms, a projectile accelerating at 100 m/sec$^2$ will obtain a velocity of 100 m/sec if a one second time interval is used. In step 76 the velocity solution is divided by four to account for the fact that the inner loop performs four iterations for every one iteration of the outer loop. Thus, at step 76 the incremental velocity calculation is made in terms of the time scale used by the outer loop.

As previously discussed, accelerometers, such as those used in the three axis accelerometer system 18 produce an output in the presence of gravitational forces. The effect of such gravitational forces are not ignored, as they may introduce errors into the solution, particularly considering that the body to which the sensors are mounted may be rotating about any or all of the yaw, pitch or roll axes as depicted in FIG. 2. Thus, the microprocessor compensates for this at step 76 by "subtracting out" the effect of gravity upon each of the acceleration axes, as dictated by the current reference frame orientation. The manner in which this is accomplished will be more fully explained in connection with FIGS. 6*a*-6*b* and 7*a*-7*b*.

With the velocity thus calculated, the microprocessor next performs another time integration to calculate displacement. As before, a dead band technique is used to disregard small values in the velocity magnitude as performed by steps 78 and 80. Time integration is performed at step 82 by multiplying the velocity by the time step interval, divided by four to take into account that there are four iterations in the inner loop for each one iteration of the outer loop. Thus at step 82 the microprocessor has calculated a current position based on acceleration data acquired by the outer loop and compensated for yaw, pitch and roll orientation at step 70.

Of course, the yaw, pitch and roll orientations cannot be assumed constant. Thus, the remaining steps 84-96 of the inner loop proceed to calculate and update the global orientation vector for use at step 70 during the subsequent iteration.

The orientation vector updating procedure begins at step 84 by linearly interpolating angular rate from the last measured value to a present value. Then at step 86 the angular rates are time integrated to compute an angular displacement value. Again, the time step is divided by four to compensate for the ratio of inner loops to outer loop. At steps 88 and 90 a dead band calculation is performed so that small angular displacements are ignored.

Computation of angular displacements can be performed using standard Euclidean geometry, Euler angles, and using a mathematical system based on the set of all integer values. Rotations in such conventionally-represented three dimensional space involve a set of computationally expensive calculations that pose practical limits on the speed at which a given microprocessor can compute rotational solutions. In addition, performing rotations in such three-space can give rise to the so-called Gimbal Lock problem, whereby under certain rotations one or more of the rotational axes can be lost if they become aligned in the same plane.

The inner loop avoids these problems by shifting the orientation calculations from conventional three-space mathematics to a four-space mathematics utilizing quaternion calculations. Unlike the conventional three-space calculations based on real numbers or integer numbers, quaternion calculations are based on a four-space numbering system that encodes three orthonormal imaginary components, sometimes represented as a three element vector and a fourth component, sometimes represented as a scalar component. Thus, if we define the following three orthonormal imaginary numbers:

i=(1, 0, 0)
j=(0, 1, 0)
k=(0, 0, 1)

The quaternion can thus be written:

$$q=q_0+\bar{q}=q_0+iq_1+jq_2+kq_3$$

In the above representation, the scalar component is $q_0$ and the vector component corresponds to the $iq_1+jq_2+kq_3$ component.

In a presently preferred embodiment, unit vectors, quaternion elements and other intermediate values that are guaranteed to be within [−2,+2] are stored as 32-bit fixed point numbers, with 2 bits integer and 30 bits fraction.

Without going into detail here, it is helpful to see that the quaternion can thus be used to encode both rotational information (in the scalar component) and positional information (in the vector component). Quaternion mathematics follows some but not all of the operations available in conventional algebra. Notably, quaternion multiplication is not commutative, thus a×b does not equal b×a.

To utilize a quaternion representation and thereby more efficiently calculate rotations, the processor creates a quaternion representation of measured angular displacements at step 92. This will be discussed more fully in connection with FIG. 6*a*-6*b*. Generally, the quaternion representation is calculated by applying predetermined trigonometric relationships to the rotation magnitude and combining those results with a normalized rotation vector to generate the scalar and vector components of the quaternion representation. Next at step 94 the current rotation quaternion is multiplied with the freshly calculated quaternion value (using a quaternion multiplication operation) to generate an updated current orientation quaternion, which is stored at step 96. Thereafter, the stored current orientation quaternion is used to compute the respective pitch, yaw and roll vectors used to calculate the Slant Distance (step 54, FIG. 4) and also used to update the gravity vector.

For a deeper understanding of the processes performed by microprocessor 22 in the outer and inner loops, refer now to FIGS. 6*a*-6*b* which shows the manner of processing the three axis gyroscope data, and also refer to FIGS. 7*a*-7*b* which shows the manner of processing the three axis accelerometer data.

Referring further to FIG. 6*a*, the respective pitch, yaw and roll outputs of the three axis gyroscope system are read at steps 100*p*, 100*y* and 100*r*. Zero measurand output (ZMO) correction values stored in memory locations designated at 102*p*, 102*y* and 102*r* are then added (scalar addition) to the respective pitch, yaw and roll data values to remove any unwanted device offsets. The scalar addition is shown at 104*p*, 104*y* and 104*r*, respectively.

Next, the scaled factors stored in memory locations 106*p*, 106*y* and 106*r* are applied by scalar multiplication at 108*p*, 108*y* and 108*r*, respectively.

Up to this point, each of the three pitch, yaw and roll calculations correspond to scalar values expressed as integers. Beyond this point, however, the system is working with vector quantities (and later quaternion quantities). The transition to vector representation takes place at process 112*p*, 112*y* and 112*r* where the scalar values from 108 are multiplied by the respective pitch vector 110*p*, yaw vector 110*y* and roll vector 110*r* that are each stored in memory. As will later be seen, these respective pitch vector, yaw vector and roll vector values are updated using the current orientation quaternion later in the process.

At step 114 the processor performs vector addition to combine the respective pitch, yaw and roll values to form a vector representation of these three orientations. As illustrated at 116, the resulting vector corresponds to a total rotation rate vector, in other words, a vector indicating the rate of change in pitch, yaw and roll with respect to time.

Flow from FIG. 6*a* then continues on FIG. 6*b* as indicated by the reference character A. It will be recalled that the inner loop is operating (in this case) four times the rate of the outer loop. Thus, by knowing the clock speed of the processor and taking into account the ratio of outer loop to inner loop iterations, a predetermined time step stored in memory at 118 is applied by scalar vector multiplication to in effect integrate the total rotation rate vector and thereby arrive at a total rotation vector as indicated at 122.

$$qrotation_{132} = \begin{bmatrix} \cos\left(\frac{\text{magnitude}_{124}}{2}\right) \\ \sin\left(\frac{\text{magnitude}_{124}}{2}\right) * x_{126} \\ \sin\left(\frac{\text{magnitude}_{124}}{2}\right) * y_{126} \\ \sin\left(\frac{\text{magnitude}_{124}}{2}\right) * z_{126} \end{bmatrix}$$

In order to represent the total rotation vector as a quaternion value, the total rotation vector 122 is split into two components: a total rotation value magnitude 124 and a normalized vector component 126. The rotation magnitude component 124 is a scalar value, whereas the normalized rotation vector 126 is a vector value. The total rotation magnitude 124 is then applied using sine and cosine trigonometric calculations 128 and 130 and these are then combined at 132 with the normalized rotation vector 126 to generate a quaternion representation of the total rotation vector. A presently preferred embodiment performs the sine and cosine calculations using lookup tables to gain speed. Square root and division operations are performed using CORDIC-type algorithms. Fixed-point multiplication support is provided via the microprocessor on-chip hardware.

The total rotation quaternion 132 corresponds to the incremental value obtained using the current readings from the pitch, yaw and roll gyroscopes as at 100*p*, 100*y* and 100*r*. This value is then combined with a previously obtained value stored in memory at 134 designated at the current orientation quaternion. In this regard, the current orientation quaternion 134 actually corresponds to the value previously calculated and in process of being updated using the value calculated at 132. More specifically, the total rotation quaternion 132 is combined with the current orientation quaternion 134 using a quaternion multiplication operation 136. The result of this multiplication is stored at step 138 back into the current orientation quaternion memory location 134. Thus, the current orientation quaternion is being updated based on information just obtained from the three axis gyroscope system.

The current orientation quaternion, having been updated, is now used to update the pitch vector 110*p*, yaw vector 110*y* and roll vector 110*r* (FIG. 6*a*). The updating step is performed by performing a vector-quaternion rotation operation (one operation for each of the three pitch, yaw and roll vectors) designated by steps 142, 148 and 154. Focusing for the moment on vector-quaternion rotation operation 142, the operation is performed by taking the current orientation quaternion and applying to it the unit vector [1.0, 0.0, 0.0] which, in effect, extracts a newly calculated pitch vector which is then stored by process 144 into the memory location 110*p* (FIG. 6*a*). Similar operations are performed for the yaw and roll vectors. Note that the unit vectors 146 and 152 differ from one another and from the unit vector 140 to allow the desired component to be selected.

Thus, it can be seen that the orientation information extracted from the three axis gyroscope system is used to update the respective pitch, yaw and roll vectors, which are in turn used in the next succeeding update operation. In addition to updating the pitch, yaw and roll vectors, the current orientation quaternion 138 is also used to update the gravity vector. This is accomplished by performing a vector-quaternion inverse rotation operation 160 upon the initial gravity vector 158. The results of this inverse rotation operation are then stored at 162. It will be recalled that the initial gravity vector was initially obtained at step 44 (FIG. 4) prior to launch. The gravity vector is mathematically rotated along with the local axis vectors (except in the opposite direction) as the device is physically rotated, such that the gravity vector always points in the same direction (down) in the global coordinate system. When calculating acceleration, the measured acceleration is mapped into the global coordinate system, and then the gravity vector is added to it to get the effective acceleration, or acceleration that actually results in motion.

Referring to FIGS. 7*a*-7*b*, the manner of processing the accelerometer data will now be described. The accelerometer data are first read from the respective x, y and z accelerometers at steps 170*x*, 170*y* and 170*z*, respectively. ZMO correction values 172*x*, 172*y* and 172*z* are then applied by scalar addition at steps 174*x*, 174*y* and 174*z*, respectively. To these values the scale factor stored in memory at 176*x*, 176*y* and 176*z* are applied by scalar multiplication at steps 178*x*, 178*y* and 178*z*. To these values the pitch, yaw and roll vectors 110*p*, 110*y* and 100*r* are applied by scalar vector operations 182*x*, 182*y* and 182*z*, respectively. These pitch, yaw and roll vectors were calculated as explained in connection with FIGS. 6*a* and 6*b*.

The result of these scalar vector operations is a set of vectors for each of the x, y and z accelerations. These are combined by vector addition at step 184 to generate a single vector value representing each of the x, y and z acceleration components. Then continuing on to FIG. 7*b* as depicted by reference character B, the gravity vector 186 is applied by a vector addition operation 188. It will be recalled that the gravity vector 186 is updated by the vector-quaternion inverse rotation operation 160 (FIG. 6*b*). Vector addition of the gravity vector at 188 effectively removes the component of the acceleration vector attributable to the force of gravity.

As was previously discussed in connection with FIG. 5, a dead band technique is used to filter out small acceleration magnitudes that might otherwise contribute to unwanted cumulative error over time. Thus if the acceleration magnitude is greater than the predetermined dead band value, time integration is performed by applying the stored time step value 192 by scalar vector multiplication step 194 to produce a vector velocity result which is then added to the previously calculated vector velocity at step 196, whereupon a second dead band calculation is performed at 198 to screen out small velocity changes that would unwantedly contribute to cumulative error.

If the velocity magnitude is greater than the predetermined dead band at step 198, a second integration step is performed at 204 by applying time step 202 in a scalar vector operation 204 to generate a position value which is ten added to the existing position as at 206. If the velocity magnitude is not greater than the dead band at step 198, the position vector is not updated, as indicated at step 200.

It will be seen that the quaternions track the rotation, so that once the processor computes the current orientation quaternion, that current value is used to transform the local axis vectors (yaw, pitch, roll) into the global coordinate system. the global axis vectors are used to determine the direction that the accelerometers are pointing, so that when they are sampled, the resulting accelerations can be added in the correct direction. The slant distance is calculated by performing a double integral on the 3D accelerations once they have been transformed into the global coordinate system.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A safing system to control arming of a device comprising:

a multi-axis accelerometer system;

a multi-axis gyroscope system;

a processor programmed to iteratively read acceleration data from the accelerometer system and apply a multi-axis rotation to the acceleration data using gyroscope data iteratively read from the gyroscope system to generate rotationally corrected acceleration data and further programmed to calculate a cumulative distance measure using the rotationally corrected acceleration data;

the processor being further programmed to compare the cumulative distance measure with a predetermined reference measure and to issue a control signal to enable arming of the device when the cumulative distance measure exceeds the reference measure.

2. The safing system of claim 1 wherein said multi-axis accelerometer system is a three-axis accelerometer system sensing acceleration separately along three orthogonal axes.

3. The safing system of claim 1 wherein said multi-axis gyroscope system is a three-axis gyroscope system sensing rotation separately in each of three orthogonal axes of rotation.

4. The safing system of claim 1 wherein said multi-axis accelerometer system is fixedly mounted on the device and wherein the multi-axis gyroscope system is fixedly mounted on the device in fixed relation to said multi-axis accelerometer system.

5. The safing system of claim 1 wherein said processor is programmed using executable instructions stored in a program memory of said processor and further comprising a nonvolatile memory coupled to said processor and containing a pre-calculated checksum datum based on said executable instructions, and wherein said processor is programmed to perform a self-test whereby it calculates a checksum datum based on said executable instructions and compares said calculated checksum datum with the pre-calculated checksum datum to verify that the processor is operational and that the executable instructions have not been altered.

6. The safing system of claim 1 further comprising a fuzing system coupled to said processor and operative to arm the device when the processor signals that the cumulative distance measure exceeds the reference measure.

7. The safing system of claim 1 further comprising a checksum validation system that tests if the processor the processor's operation is impaired and further comprising a fuzing system coupled to said processor and to said checksum validation system, the fuzing system being operative to arm the device when the processor signals that the cumulative distance measure exceeds the reference measure and the checksum validation system determines that the processor's operation is not impaired.

8. The safing system of claim 1 further comprising supervisory control system coupled to said processor and operative to cause the processor to commence iterative operation upon launch of the device.

9. The safing system of claim 1 further comprising gravity compensator implemented by said processor to reduce the effects upon the multi-axis accelerometer of the forces of gravity.

10. The safing system of claim 9 wherein said gravity compensator is rotationally corrected by the processor using gyroscope data iteratively read from the multi-axis gyroscope system.

11. The safing system of claim 1 wherein the processor is programmed to generate rotationally corrected acceleration data by transforming the gyroscope data into a quaternion representation and using the quaternion representation to rotationally correct the acceleration data.

12. The safing system of claim 1 wherein the processor is programmed to transform the gyroscope data into a quaternion representation and using the quaternion representation to generate a rotation quaternion that is applied to a previously stored orientation quaternion to calculate a current orientation quaternion, and wherein the processor uses the current orientation quaternion to generate the rotationally corrected acceleration data.

13. The safing system of claim 1 wherein the processor is programmed to ignore iteration-to-iteration differences in accelerations below a predetermined threshold.

14. The safing system of claim 1 wherein the processor is programmed to ignore iteration-to-iteration differences in rotations below a predetermined threshold.

15. The safing system of claim 1 wherein said processor is programmed to convert the rotationally corrected acceleration data into displacement data by time integration.

16. The safing system of claim 1 wherein the multi-axis gyroscope system supplies rotation rate data and said processor is programmed to convert the rotation rate data into rotation angle data by time integration.

17. The safing system of claim 1 wherein said processor is configured to manipulate said rotationally corrected acceleration data as integer data.

18. The safing system of claim 1:

wherein said multi-axis accelerometer system is fixedly mounted on the device;

wherein the multi-axis gyroscope system is fixedly mounted on the device in fixed relation to said multi-axis accelerometer system; and wherein the device further includes a guidance system separate from said multi-axis accelerometer system and said multi-axis gyroscope system.

19. The safing system of claim 1 wherein the processor is programmed to perform an outer processing loop that calculates the cumulative distance measure based on rotationally corrected displacement values that are iteratively calculated by an inner processing loop that operates at a frequency higher than the outer loop.

20. A method of controlling arming of a device, comprising the steps of:

using a processor to iteratively read acceleration data from a multi-axis accelerometer system and to apply a multi-axis rotation to the acceleration data using data iteratively read from a multi-axis gyroscope system to generate rotationally corrected acceleration data;

using a processor to calculate a cumulative distance measure using the rotationally corrected acceleration data;

using a processor to compare the cumulative distance measure with a predetermined reference measure and to issue a control signal to enable arming of the device when the cumulative distance measure exceeds a reference measure.

21. The method of claim 20 wherein said multi-axis accelerometer system is a three-axis accelerometer system sensing acceleration separately along three orthogonal axes.

22. The method of claim 20 wherein said multi-axis gyroscope system is a three-axis gyroscope system sensing rotation separately in each of three orthogonal axes of rotation.

23. The method of claim 20 further comprising fixedly mounting the multi-axis accelerometer system and the multi-axis gyroscope system to the device, the multi-axis accelerometer system and the multi-axis gyroscope system being mounted in fixed relation to one another.

24. The method of claim 20 further comprising using a processor to compute a checksum datum based on self-executable instructions and comparing the computed checksum to a pre-calculated checksum datum to verify that the processor is operational and that the self-executable instructions have not been altered.

25. The method of claim 20 further comprising using a processor to signal to a fuzing system that the cumulative distance measure exceeds the reference measure.

26. The method of claim 20 further comprising using a processor to compute a checksum datum based on self-executable instructions and comparing the computed checksum to a pre-calculated checksum datum to test whether the processor's operation is impaired and further comprising using a processor to signal to a fuzing system that the cumulative distance measure exceeds the reference measure and the processor's operation is not impaired.

27. The method of claim 20 wherein the step of using a processor to calculate a cumulative distance measure using the rotationally corrected acceleration data is initiated upon launch of the device.

28. The method of claim 20 using a processor to compensate for gravity to reduce the effects upon the multi-axis accelerometer of the forces of gravity.

29. The method of claim 28 wherein the step of compensating for gravity is performed by rotationally correcting a gravity measure using gyroscope data iteratively read from the multi-axis gyroscope system.

30. The method of claim 20 wherein a processor generates rotationally corrected acceleration data by transforming the gyroscope data into a quaternion representation and using the quaternion representation to rotationally correct the acceleration data.

31. The method of claim 20 wherein a processor transforms the gyroscope data into a quaternion representation and using the quaternion representation to generate a rotation quaternion that is applied to a previously stored orientation quaternion to calculate a current orientation quaternion, and wherein the processor uses the current orientation quaternion to generate the rotationally corrected acceleration data.

32. The method of claim 20 further comprising ignoring iteration-to-iteration differences in rotations below a predetermined threshold.

33. The method of claim 20 wherein a processor converts the rotationally corrected acceleration data into displacement data by time integration.

34. The method of claim 20 wherein the multi-axis gyroscope system supplies rotation rate data and a converts the rotation rate data into rotation angle data by time integration.

35. The method of claim 20 wherein the rotationally corrected acceleration data are manipulated as integer data.

36. The method of claim 20 further comprising using a processor to perform an outer processing loop that calculates the cumulative distance measure based on rotationally corrected displacement values that are iteratively calculated by an inner processing loop that operates at a frequency higher than the outer loop.

* * * * *